US008457333B2

(12) United States Patent
Yeates et al.

(10) Patent No.: US 8,457,333 B2
(45) Date of Patent: Jun. 4, 2013

(54) ELECTROMAGNETIC INTERFERENCE SHIELDS WITH PIEZOS

(75) Inventors: Kyle Yeates, Palo Alto, CA (US); Stephen Brian Lynch, Portola Valley, CA (US); Teodor Dabov, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/401,729

(22) Filed: Feb. 21, 2012

(65) Prior Publication Data

US 2012/0148081 A1 Jun. 14, 2012

Related U.S. Application Data

(63) Continuation of application No. 12/236,452, filed on Sep. 23, 2008, now Pat. No. 8,126,170.

(60) Provisional application No. 61/094,811, filed on Sep. 5, 2008.

(51) Int. Cl.
*H04R 25/00* (2006.01)

(52) U.S. Cl.
USPC ..... 381/190; 381/345; 381/386

(58) Field of Classification Search
USPC ..... 381/174, 190, 345, 386, 388
See application file for complete search history.

(56) References Cited

U.S. PATENT DOCUMENTS

| | | | | |
|---|---|---|---|---|
| 4,969,197 | A | | 11/1990 | Takaya |
| 5,406,038 | A | * | 4/1995 | Reiff et al. ..... 181/167 |
| 5,736,808 | A | | 4/1998 | Szilagyi et al. |
| 5,796,854 | A | | 8/1998 | Markow |
| 5,907,625 | A | | 5/1999 | Kanai et al. |
| 5,953,414 | A | | 9/1999 | Abraham et al. |
| 6,501,016 | B1 | | 12/2002 | Sosnowski |
| 6,940,010 | B2 | | 9/2005 | Cunningham et al. |
| 7,109,817 | B2 | | 9/2006 | Kolb et al. |
| 7,129,422 | B2 | | 10/2006 | Arnold |
| 7,259,969 | B2 | | 8/2007 | Zarganis et al. |
| 7,769,457 | B2 | | 8/2010 | Fonte |
| 8,031,864 | B2 | | 10/2011 | Rosenblatt |
| 8,126,170 | B2 | | 2/2012 | Yeates et al. |
| 2001/0033478 | A1 | | 10/2001 | Ortiz et al. |

(Continued)

FOREIGN PATENT DOCUMENTS

| | | | |
|---|---|---|---|
| JP | 04107597 | | 4/1992 |
| JP | 06-036153 | | 5/1994 |
| JP | 2003198694 A | * | 7/2003 |

OTHER PUBLICATIONS

International search Report and Written Opinion for PCT/US2009/053210 mailed Dec. 14, 2009.

(Continued)

*Primary Examiner* — Charles Garber
*Assistant Examiner* — Abdulfattah Mustapha
(74) *Attorney, Agent, or Firm* — Womble Carlyle Sandridge & Rice LLP

(57) ABSTRACT

Methods and apparatus for improving the acoustical performance associated with a speaker, such as a piezoelectric speaker, are disclosed. According to one aspect, an apparatus includes a substrate, a can mounted on the substrate, and a piezoelectric speaker arrangement. The piezoelectric speaker arrangement is at least partially mounted on the can. In one embodiment, the substrate is a printed circuit board (PCB) and the can is an electromagnetic interference (EMI) shielding can.

23 Claims, 10 Drawing Sheets

U.S. PATENT DOCUMENTS

| | | | | |
|---|---|---|---|---|
| 2002/0009905 | A1 | 1/2002 | Poplawski et al. | |
| 2006/0272857 | A1 | 12/2006 | Arnold | |
| 2007/0013042 | A1 | 1/2007 | Henell et al. | |
| 2007/0121967 | A1 | 5/2007 | Sjursen et al. | |
| 2008/0037238 | A1 | 2/2008 | Kimata et al. | |
| 2008/0080160 | A1 | 4/2008 | English et al. | |
| 2008/0085021 | A1 | 4/2008 | Shim | |
| 2008/0103655 | A1 | 5/2008 | Turnbull et al. | |
| 2008/0281691 | A1 | 11/2008 | Pearson et al. | |
| 2009/0034777 | A1* | 2/2009 | Nho et al. | 381/386 |
| 2009/0154756 | A1* | 6/2009 | Eaton et al. | 381/388 |
| 2009/0274336 | A1* | 11/2009 | Infanti | 381/386 |
| 2010/0061577 | A1 | 3/2010 | Yeates et al. | |
| 2010/0061584 | A1 | 3/2010 | Lin | |
| 2010/0246143 | A1 | 9/2010 | Dinh et al. | |

OTHER PUBLICATIONS

Preliminary Examination Report for PCT/US2009/053210 mailed Mar. 17, 2011.

Office Action for U.S. Appl. No. 12/236,452, mailed Jul. 14, 2011.

Notice of Allowance for U.S. Appl. No. 12/236,452, mailed Oct. 21, 2011.

* cited by examiner

ELECTROMAGNETIC INTERFERENCE SHIELDS WITH PIEZOS

CROSS-REFERENCE TO OTHER APPLICATIONS

This application is a continuation of U.S. patent application Ser. No. 12/236,452, filed Sep. 23, 2008, now U.S. Pat. No. 8,126,170 entitled "ELECTROMAGNETIC INTERFERENCE SHIELDS WITH PIEZOS", which is hereby incorporated herein by reference, and which in turn claims priority to U.S. Provisional Patent Application No. 61/094,811, filed Sep. 5, 2008, entitled "ELECTROMAGNETIC INTERFERENCE SHIELDS WITH PIEZOS", which is hereby incorporated herein by reference.

This application also references U.S. Provisional Patent Application No. 61/094,816, filed Sep. 5, 2008, entitled "COMPACT HOUSING FOR PORTABLE ELECTRONIC DEVICE WITH INTERNAL SPEAKER", which is hereby incorporated herein by reference.

BACKGROUND OF THE INVENTION

1. Field of the Invention

The present invention relates to the manufacture of devices which include acoustical speakers.

2. Description of the Related Art

Piezoelectric speakers, or piezo speakers, are often used in small electronic devices such as portable media players and cellular telephones because of their low profile and relatively small footprint. As will be appreciated by those skilled in the art, piezo speakers create sound by forming vibrations with a diaphragm via a piezoelectric driver. In general, the sound quality associated with piezo speakers is adequate, but is often not to the level that may be desired in particular applications. The sound quality associated with piezo speakers may be worsened by the actual placement of the piezo speakers within electronic devices. That is, the location at which a piezo speaker is placed may not be a location which is not substantially optimal for the performance of the piezo speaker. Piezo speakers are often placed wherever they fit within electronic devices, without regard for whether the placement of the piezo speakers provides substantially the best sound quality that may be achieved by the piezo speakers.

Although components within an electronic device, e.g., components mounted on a printed circuit board of the electronic device, may be moved to accommodate the placement of a piezo speaker such that the sound quality associated with the electronic device may be enhanced. However, moving other components is not always possible. For example, moving some components may adversely affect the overall performance of an electronic device.

Therefore, what is needed is a method and an apparatus which allows piezo speakers to be located within electronic devices such that the piezo electric speakers provide a relatively high sound quality without compromising the performance of other components within the electronic devices.

SUMMARY OF THE INVENTION

The present invention pertains to a method and an apparatus which allows a speaker to substantially cooperate with other components of an electronic device to provide improved acoustical output. For example, a speaker, such as a piezoelectric speaker, can utilize an electromagnetic interference (EMI) shield to provide improved audio from the electronic device.

The present invention may be implemented in numerous ways, including, but not limited to, as a method, system, device, or apparatus. Example embodiments of the present invention are discussed below.

According to one embodiment, an electronic apparatus includes at least: a substrate configured to support one or more electronic components coupled thereto; a can secured to the substrate over and around the one or more electronic components; and a speaker at least partially mounted on the can.

According to one embodiment, an electronic device includes at least a printed circuit board (PCB), a component and a speaker. The component can be mounted on the PCB and substantially enclose a volume of air. The speaker can be mounted on a surface of the component so that the volume of air enclosed by the component serves as a back volume for enhancing sound waves produced by the speaker.

According to one embodiment, an apparatus includes a substrate, a can mounted on the substrate, and a piezoelectric speaker arrangement. The piezoelectric speaker arrangement is at least partially mounted on the can. In one embodiment, the substrate is a printed circuit board (PCB) and the can is an EMI shielding can.

According to another one embodiment, an electronic device includes a PCB, at least one electrical component mounted on the PCB, and an EMI shield mounted on the PCB over and around the electrical component. The electronic device also includes a piezoelectric speaker arrangement. The piezoelectric speaker arrangement includes a diaphragm element that is mounted on a surface of the EMI shield.

In accordance with yet another embodiment, a method of assembling an electronic device includes attaching at least a portion of a piezoelectric speaker arrangement to an EMI can, and then attaching the EMI can to a PCB. The PCB has at least one electrical component mounted thereon. The EMI can is attached or mounted to the PCB over and around the electrical component.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, in which.

DETAILED DESCRIPTION OF THE INVENTION

Example embodiments of the present invention are discussed below with reference to the various figures. However, those skilled in the art will readily appreciate that the detailed description given herein with respect to these figures is for explanatory purposes, as the invention extends beyond these embodiments.

The present invention pertains to a method and an apparatus which allows a speaker to substantially cooperate with other components of an electronic device to provide improved acoustical output. For example, a speaker, such as a piezoelectric speaker, can utilize an electromagnetic interference (EMI) shield to provide improved audio from the electronic device.

Electronic devices, e.g., portable media players, mobile phones, personal digital assistants, generate electromagnetic interference (EMI). EMI is a disturbance which can have an adverse effect on other nearby electrical circuits. To reduce the effects of EMI, EMI shields or EMI shielding cans are often used to mitigate electromagnetic disturbances.

In one embodiment, a piezoelectric speaker, or a piezo speaker, may be attached to or otherwise mounted on an EMI shielding can such that the resultant arrangement is effectively a combination speaker and EMI shield. By attaching a piezo speaker, or some feature of the piezo speaker, on an EMI shielding can of an electronic device, the performance of the piezo speaker may be enhanced. When at least a part of the piezo speaker is attached to a surface of the EMI shielding can, overall acoustical performance associated with the electronic device can be improved. When the piezo speaker vibrates, the EMI shielding can amplifies the sound generated by the piezo speaker.

Mounting a piezo speaker arrangement, or some portion thereof, on an EMI shielding generally does not affect the shielding capabilities provided by the EMI shielding can. Further, the placement of the piezo speaker typically does not impinge on the placement of the EMI shielding can or other components of an electronic device. Hence, the placement of a piezo speaker on the EMI shielding can of the electronic device enhances the sound quality provided by the piezo speaker without adversely impacting the performance of other components within the electronic device.

To further improve the sound quality associated with an electrical device which includes a piezo speaker, the piezo speaker may effectively be attached to an EMI shielding can and sealed thereto such that a back volume for the piezo speaker includes the volume (or air) within the EMI shield can. The existence of the enlarged back volume further enhance the sound quality provided by an overall speaker arrangement that includes the piezo speaker and the EMI shielding can.

Figure 1:
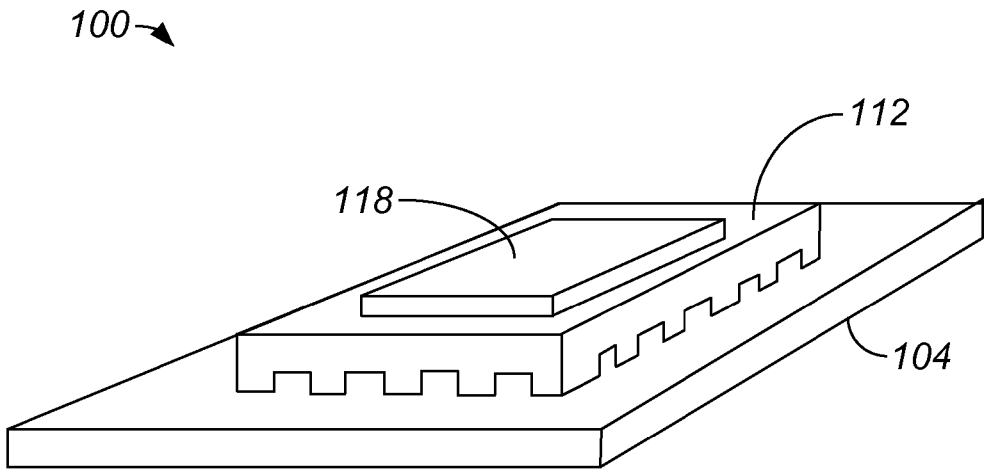
FIG. 1 is a diagrammatic representation of a printed circuit board (PCB) assembly which includes a piezo speaker mounted on an electromagnetic interference (EMI) shielding can in accordance with an embodiment of the present invention.

As will be appreciated by those skilled in the art, an EMI shielding can may be attached to a printed circuit board (PCB) or, more generally, a substrate of an electronic device. Such a PCB may be supported within a housing of the electronic device. A PCB assembly which includes a PCB that supports an EMI shielding can on which a piezo speaker is mounted will be described in accordance with an embodiment of the present invention. As illustrated in FIG. 1, a PCB assembly 100 includes a PCB 104 on which electrical traces are typically formed and electrical components (not shown) are mounted. An EMI shield or EMI shielding can 112 is positioned over and around the electrical components (not shown), and substantially attached to PCB 104.

EMI shielding can 112 may be formed from substantially any material which is suitable for providing EMI shielding. By way of example, EMI shielding can 112 may be formed from a metal. Other materials form which EMI shielding can 112 may be formed include, but are not limited to including, non-metal materials which include a metallic layer. Such non-metal materials may include composite materials, laminated materials, paper, rubber, plastic, ceramics, fiberglass, and glass. A metallic layer may be formed, as for example coated or painted, onto the non-metal materials. In one embodiment, EMI shielding can 112 may be formed from a rubber material that is coated with metal.

A piezo speaker 118 is mounted on or attached to EMI shielding can 112. Piezo speaker 118 may include components including, but not limited to including, a piezo element, e.g., a diaphragm or thin membrane, and a piezo driver element. It should be appreciated that although piezo speaker 118 is shown as being mounted to a top surface or wall of EMI shielding can 112, piezo speaker 118 may generally be mounted on substantially any surface of EMI shielding can 112. As the top surface of EMI shielding can 112 often extends over a relatively large area of PCB 104, piezo speaker 118 is typically mounted on the top surface of EMI shielding can 112 rather than a side surface of EMI shielding can 112 due to the better acoustical performance that may be achieved. Piezo speaker 118 may be mounted on EMI shielding can 112 using any suitable method. By way of example, piezo speaker 118 may be attached to EMI shielding can 112 using an adhesive material (e.g., epoxy, glue, etc).

Figure 2A:
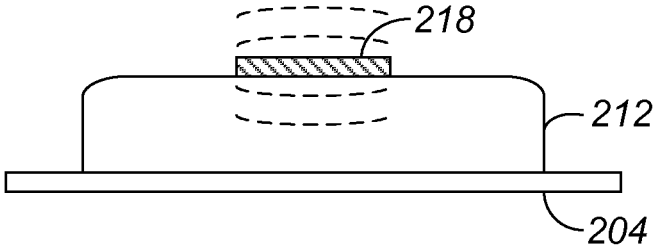
FIG. 2A is a block diagram side-view representation of a piezo speaker vibrating when mounted on an EMI shielding can in accordance with an embodiment of the present invention.

When piezo speaker 118 vibrates, EMI shielding can 112 vibrates and, thus, causes sound generated by piezo speaker 118 to be substantially amplified. FIG. 2A is a block diagram side-view representation of a piezo speaker vibrating when mounted on an EMI shielding can in accordance with an embodiment of the present invention. A piezo speaker 218 is mounted on an EMI shielding can 212 which, in turn, is attached to a substrate such as a PCB 204. Piezo speaker 218 may vibrate, as shown. In general, piezo speaker 218 includes a relatively thin membrane or diaphragm which vibrates to create sound when driven by a piezo driver.

Figure 2B:
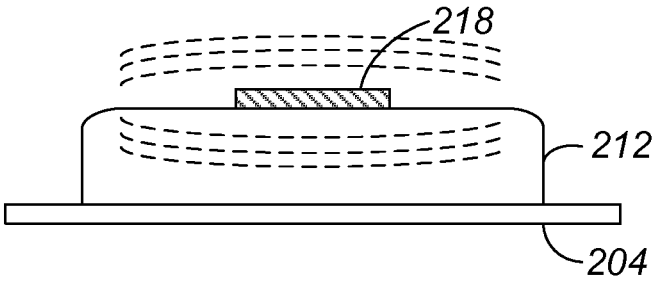
FIG. 2B is a block diagram side-view representation of an EMI shielding can, e.g., EMI shielding can 212 of FIG. 2A, vibrating with a piezo speaker mounted thereon in accordance with an embodiment of the present invention.

The vibrations associated with piezo speaker 218 effectively cause EMI shielding can 212 to vibrate. FIG. 2B is a block diagram side-view representation of EMI shielding can 212 vibrating along with piezo speaker 218 in accordance with an embodiment of the present invention. When piezo speaker 218 vibrates, the vibrations are transmitted to EMI shielding can 212 which, in turn, also vibrates. When EMI shielding can 212 vibrates, the lower end frequency response associated with the sounds generated by the vibration of piezo speaker 218 is typically increased, i.e., the sound pressure level or loudness is increased. That is, EMI shielding can 212 amplifies the sound generated by piezo speaker 218 by vibrating along with piezo speaker 218.

Figure 3A:
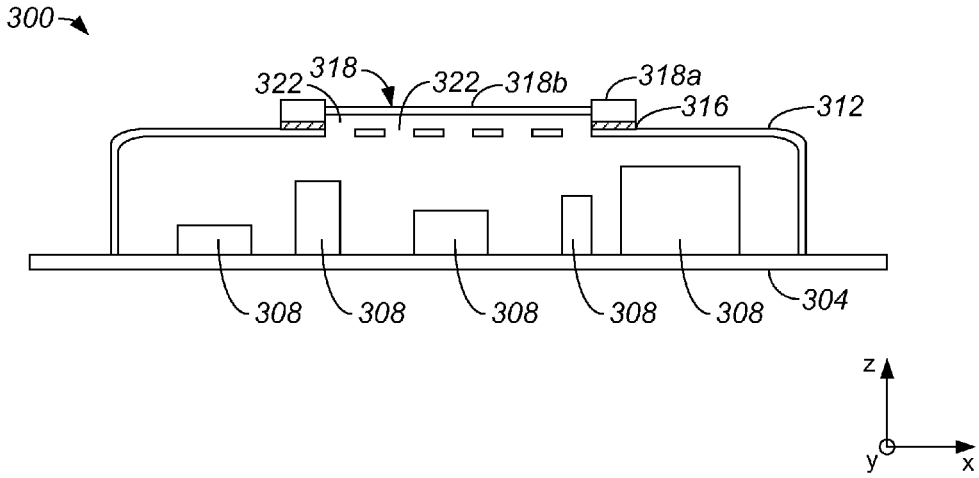
FIG. 3A is a diagrammatic side-view cross-sectional representation of a PCB assembly which includes a piezo speaker mounted on an EMI shielding can that includes openings in a top surface in accordance with an embodiment of the present invention.
Figure 3B:
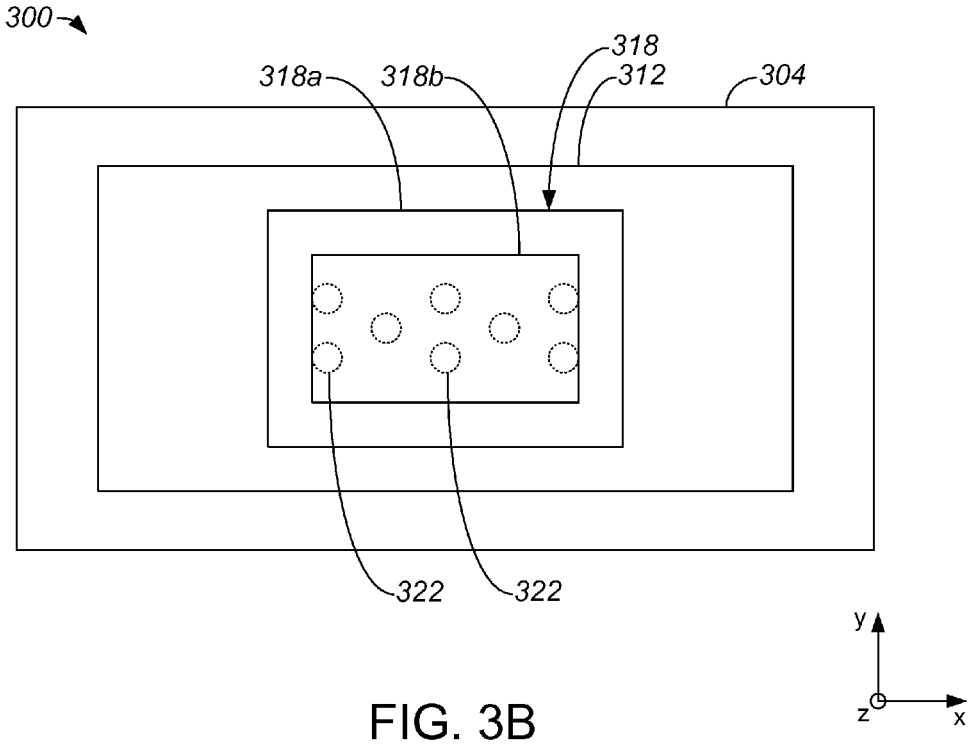
FIG. 3B is a diagrammatic top-view representation of a PCB assembly, e.g., PCB assembly 300 of FIG. 3A, in accordance with an embodiment of the present invention.

In one embodiment, an EMI shielding can may include openings in a top surface. The openings allow the sound waves generated by the piezo speaker 218 into the EMI shielding can, provided that the EMI shield can is otherwise substantially sealed (e.g., to the PCB). This allows the volume of air within EMI shield to be used as at least part of the back volume for the piezo speaker. FIG. 3A is a diagrammatic side-view cross-sectional representation of a PCB assembly which includes a piezo speaker mounted on an EMI shielding can that includes openings in a top surface, and FIG. 3B is a diagrammatic top-view representation of the PCB assembly in accordance with an embodiment of the present invention. As shown in FIG. 3, PCB assembly 300 includes a PCB 304 or, more generally, a substrate. Various components 308, e.g., electrical components, are mounted on PCB 304.

PCB assembly 300 also includes an EMI shielding can 312 in which openings 322 are defined. The number of openings 322, as well as the size and shape of openings 322, may vary widely. In this embodiment, openings 322 are provided on a top surface of EMI shielding can 312. A piezo speaker arrangement 318 can be mounted on the top surface of EMI shielding can 312 such that openings 322 are substantially covered or overlaid by piezo speaker arrangement 318. The opening 322 allowing the internal volume of EMI shielding can 312 to serve as a substantially portion of a back volume for piezo speaker arrangement 318.

Piezo speaker arrangement 318 includes, in one embodiment, a support member 318*a* that holds or otherwise supports a diaphragm 318*b*. Support member 318 may generally support any number of sides of diaphragm 318*b*. By way of example, support member 318 may support all sides of diaphragm 318*b* along its periphery. A piezo driver (not shown) may be used to cause diaphragm 318*b* to vibrate. In one embodiment, diaphragm 318*b* is a relatively thin rubber membrane or any other thin structure that vibrates when driven by a piezo driver (not shown). Support member 318*a* may be directly attached to a top surface of EMI shielding can 312 or indirectly attached to the top surface of EMI shielding can 312 via a gasket 316. As shown, gasket 316 can serve as an interface through which piezo speaker arrangement 318 is mounted on EMI shielding can 312 substantially over openings 322. As an example, an adhesive material, such as epoxy or glue, can be used to attach support member 318*a* directly or indirectly to the top surface of EMI shield can 312.

Figure 4:
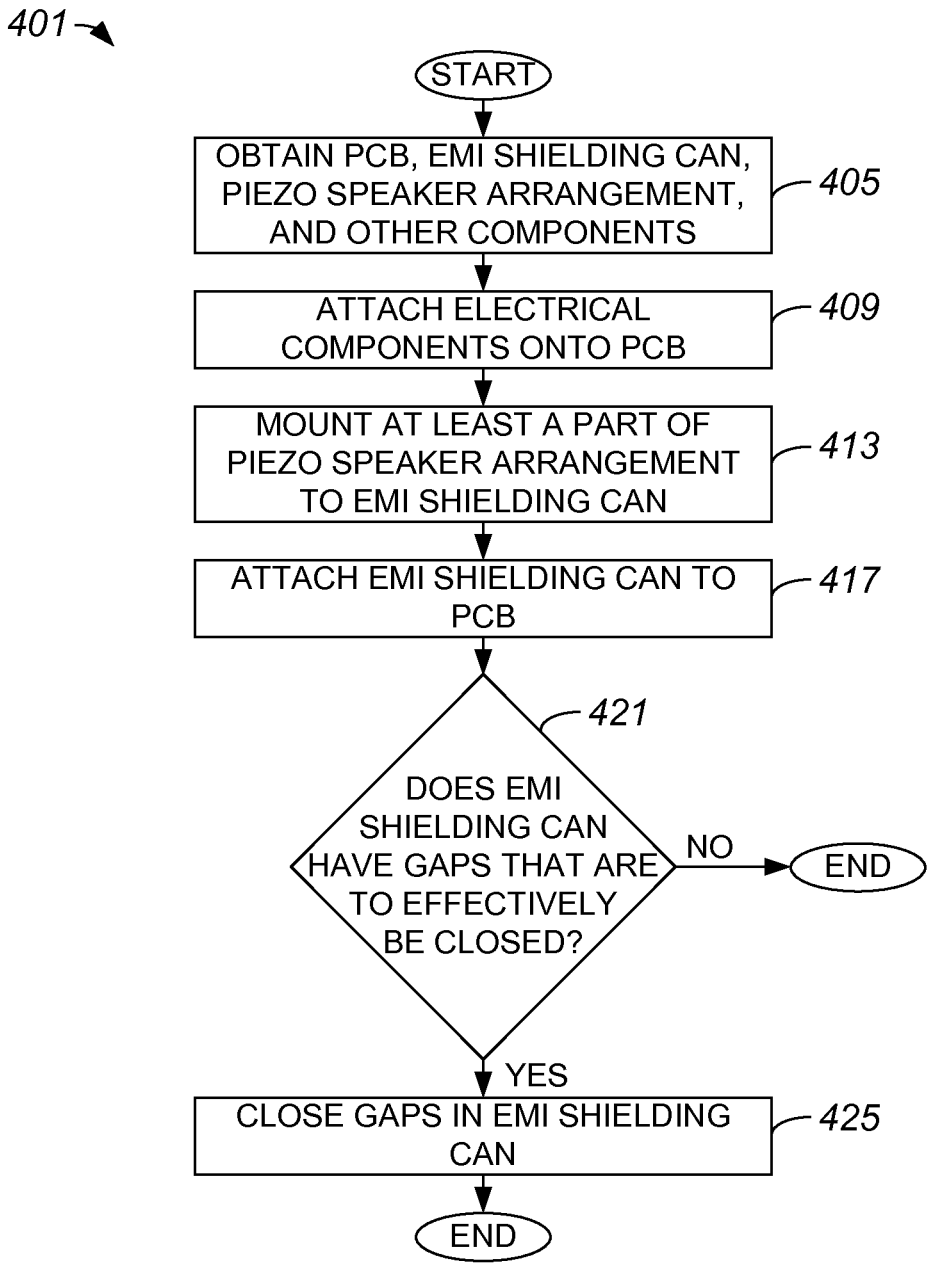
FIG. 4 is a process flow diagram which illustrates a method of assembling a PCB assembly that includes a piezo speaker mounted on an EMI shielding can in accordance with an embodiment of the present invention.

With reference to FIG. 4, one method of assembling a PCB assembly that includes a piezo speaker mounted on an EMI shielding can will be described in accordance with an embodiment of the present invention. A process 401 of assembling a PCB assembly begins at step 405 in which a PCB, an EMI shielding can, a piezo speaker arrangement, and other components, e.g., electrical components, are obtained. That is, the parts which are to form an overall PCB assembly are obtained.

The electrical components are attached to the PCB in step 409. Attaching electrical components to the PCB generally includes soldering electrical components to the PCB, as will be appreciated by those skilled in the art. After electrical components are attached to the PCB, at least a part of a piezo speaker arrangement is mounted to the EMI shielding can in step 413. In one embodiment, substantially all of a piezo speaker arrangement may be mounted to the EMI shielding can. It should be appreciated, however, that part of the piezo speaker arrangement, e.g., a piezo diaphragm and a support structure, may essentially be mounted on the EMI shielding can while other parts of the piezo speaker arrangement, e.g., a piezo speaker driver, may be mounted off of the EMI shielding can.

Once at least a part of the piezo speaker arrangement is mounted on the EMI shielding can in step 413, the EMI shielding can is attached to the PCB in step 417. Attaching the EMI shielding can to the PCB may include, but is not limited to including, soldering, adhering or otherwise securing the EMI shielding can to the PCB.

Some EMI shielding cans include gaps (or openings) formed around the edges. In one embodiment, such gaps are substantially closed in order to improve the acoustical qualities associated with the speaker assembly formed from the piezo speaker and the EMI shielding can. As such, a determination is made in step 421 as to whether the EMI shielding can has gaps that are to effectively be closed. If the determination is that the EMI shielding can does not have gaps that are to effectively be closed, the process of assembling a PCB assembly is completed. Alternatively, if it is determined that the EMI shielding can has gaps that are effectively to be closed, then the gaps are effectively closed in step 425. The gaps can be effectively closed by being covered or filled. For example, closing the gaps may include, but is not limited to including, taping over the gaps, filling the gaps with a material such as foam, or applying solder in the gaps. After the gaps in the EMI shielding can are effectively closed, the process of assembling a PCB assembly is completed.

Figure 5A:
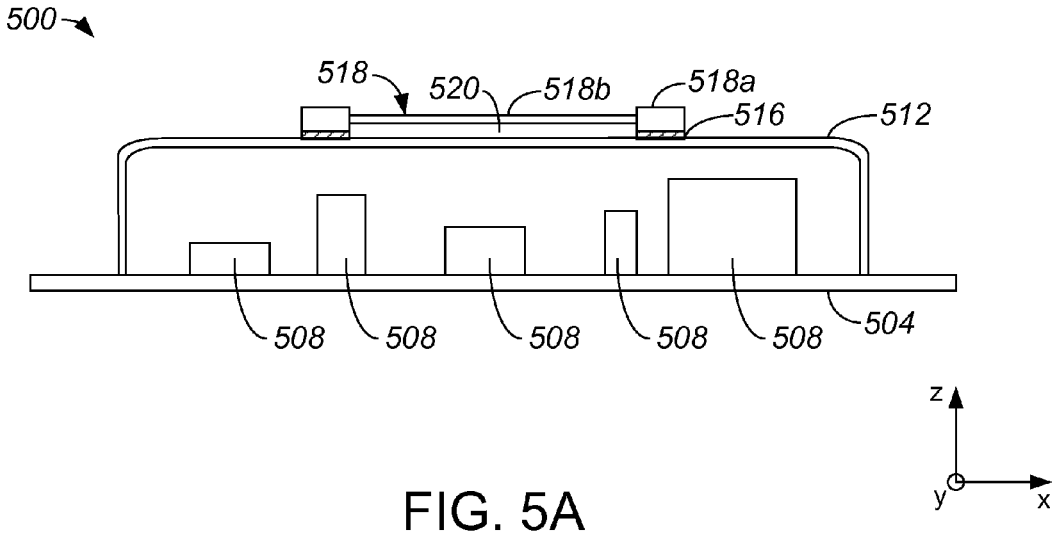
FIG. 5A is a diagrammatic side-view cross-sectional representation of a PCB assembly which includes a piezo speaker mounted on an EMI shielding can that does not include openings in a top surface in accordance with an embodiment of the present invention.
Figure 5B:
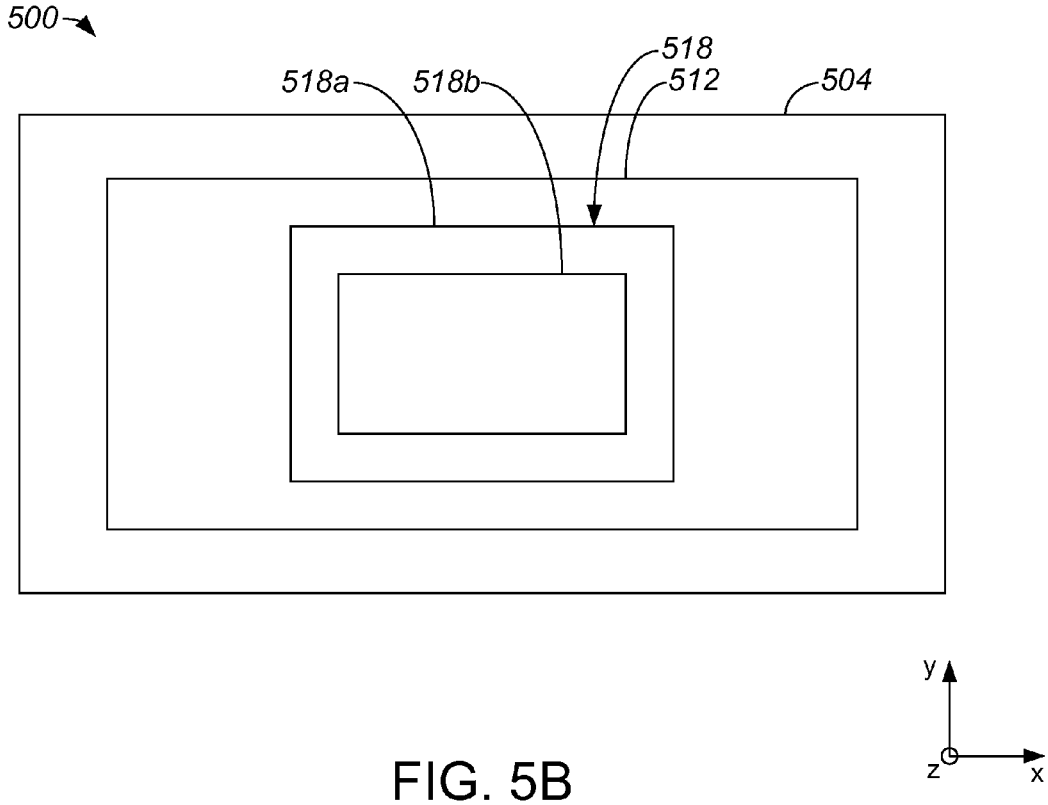
FIG. 5B is a diagrammatic top-view representation of a PCB assembly, e.g., PCB assembly 500 of FIG. 5A, in accordance with an embodiment of the present invention.

As described above with respect to FIGS. 3A and 3B, a top surface of an EMI shielding can may include openings. Such openings effectively enable the internal volume of the EMI shielding can to form a back volume of an overall speaker arrangement formed from the EMI shielding can and a piezo speaker. It should be appreciated, however, that the top surface of an EMI shielding can may include no openings. When the top surface of an EMI shielding can does not include openings, a back volume may be formed between a piezo speaker and the top surface of the EMI shielding can. Referring next to FIGS. 5A and 5B, a PCB assembly which includes a piezo speaker mounted on an EMI shielding can that does not include openings in a top surface will be described in accordance with an embodiment of the present invention. FIG. 5A is a diagrammatic side-view cross-sectional representation of a PCB assembly, and FIG. 5B is a diagrammatic top-view representation of the PCB assembly.

A PCB assembly 500 includes a PCB or a substrate 504 into which various components 508, e.g., electrical components, are mounted. An EMI shielding can 512, which includes substantially no holes in a top surface, is mounted to PCB 504 such that EMI shielding can 512 is essentially positioned around and over components 508. That is, EMI shielding can 512 is arranged to shield components 508.

A piezo speaker arrangement 518 is mounted on a top surface of EMI shielding can 512. Piezo speaker arrangement 518 includes a support member 518*a* that holds a diaphragm 518*b*. Support member 518*a* is effectively attached to a top surface of EMI shielding can 512 through a gasket 516. That is, gasket 516 is the interface through which piezo speaker arrangement 518 is mounted on EMI shielding can 512. It should be appreciated, however, that in lieu of gasket 516, support member 518*a* may be substantially directly mounted to EMI shielding can 512, e.g., using an adhesive material such as epoxy.

A space 520 formed between diaphragm 518*b*, or a flexible membrane, and a top surface of EMI shielding can 512 may be a back volume of an overall speaker that includes EMI shielding can 512 and piezo speaker arrangement 518. In one embodiment, the distance between the top surface of EMI shielding can 512 and diaphragm 518*b* is in the range of approximately 0.05 millimeters to 2.0 millimeters. The distance and, hence, the size of the back volume, may generally be adjusted by varying the thickness of gasket 516 and/or support member 518*a*.

Figure 6:
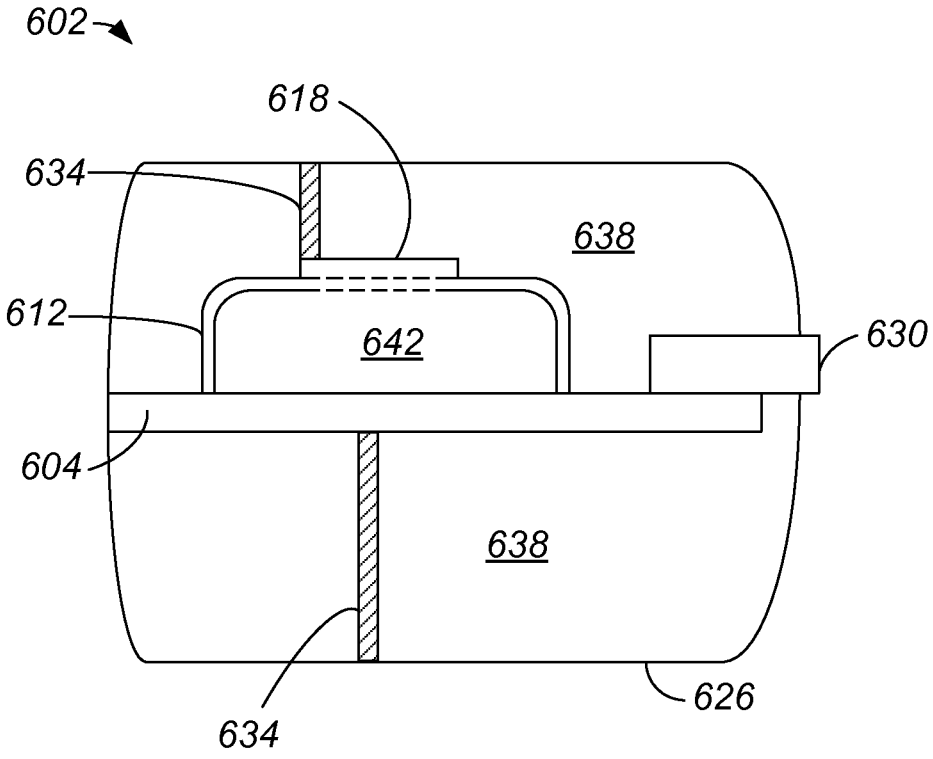
FIG. 6 is a diagrammatic side-view representation of a portable electronic device in which front and back volumes are created for use with a piezo speaker mounted on an EMI shielding can in accordance with an embodiment of the present invention.

In one embodiment, a piezo speaker mounted on an EMI shielding can may be incorporated into an overall system such that front and back volumes are defined. FIG. 6 is a diagrammatic side-view representation of a portable electronic device in which front and back volumes are created for use with a piezo speaker mounted on an EMI shielding can in accordance with an embodiment of the present invention. A portable electronic device 602 includes a PCB 604 on which an EMI shielding can 612 is mounted. A piezo speaker 618 is mounted on EMI shielding can 612. The portion of the EMI shielding can 612 adjacent piezo speaker 618 may include one or more openings 619 over which piezo speaker 618 is mounted.

A connector 630, e.g., a 30-pin connector, is mounted on PCB 604 such that connector 630 is able to be associated with a front volume 638 within a housing 626. The connector 630 also services as an audio exit opening through which audio sounds can be emitted. A back volume 642 can be defined by an internal volume of EMI shielding can 612. Here, EMI shielding can 612 is sealed to PCB 604 so that the internal volume is an enclosed volume. Additionally, one or more seals 634 can be provided within portable electronic device 602 to create a front volume 638 for piezo speaker 618.

Figure 7:
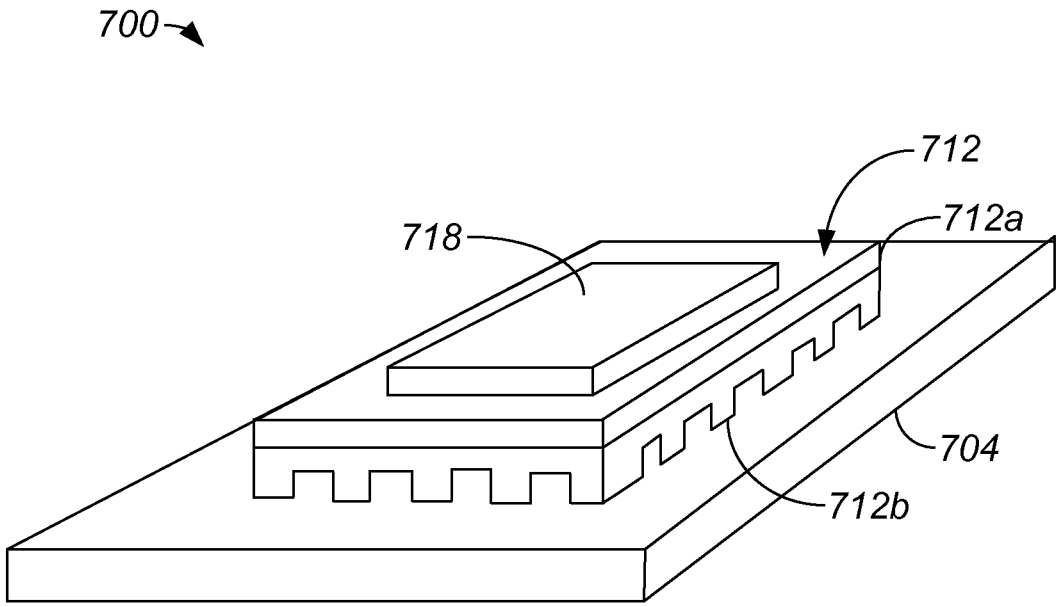
FIG. 7 is a diagrammatic representation of a PCB assembly which includes a piezo speaker mounted on an EMI shielding can formed from a fence and a cover in accordance with an embodiment of the present invention.

An EMI shielding can has generally been described as being formed from a single piece, as for example a single piece of stamped sheet metal. In lieu of being formed from a single piece, an EMI shielding can may be formed from multiple separate pieces. FIG. 7 is a diagrammatic representation of a PCB assembly which includes a piezo speaker mounted on an EMI shielding can formed from two substantially separate pieces in accordance with an embodiment of the present invention. A PCB assembly 700 includes a PCB 704 on which electrical traces are typically formed and electrical components (not shown) are mounted. An EMI shielding can assembly 712 is positioned over and around the electrical components (not shown), and substantially attached to PCB 704.

EMI shielding can assembly 712 includes a cover 712*a* and a fence 712*b*. Fence 712*b* is generally configured to be attached to PCB 704, and cover 712*a* is configured to substantially engage with fence 712*b* to form EMI shielding can assembly 712. Cover 712*a* may, in one embodiment, be sealed against fence 712*b*. A piezo speaker 718 is generally mounted on a top surface of cover 712*a*.

Figure 8:
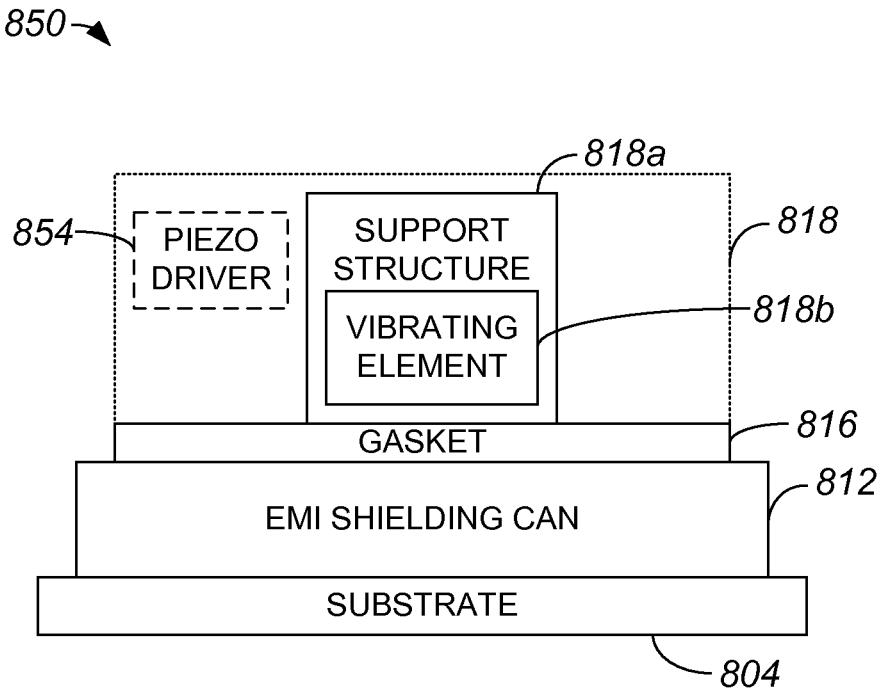
FIG. 8 is a block diagram representation of an overall speaker arrangement which includes a piezo speaker and an EMI shielding can in accordance with an embodiment of the present invention.

With reference to FIG. 8, one embodiment of a speaker arrangement which includes a piezo speaker and an EMI shielding can will be described in accordance with the present invention. An overall speaker arrangement 850 includes a piezo speaker arrangement 818 that is mounted on an EMI shielding can 812. EMI shielding can 812 is typically mounted on a PCB or, more generally, a substrate 804. Piezo speaker arrangement 818 includes a support structure 818*a* which supports a vibrating element 818*b*, e.g., a diaphragm or a thin membrane, over a surface of EMI shielding can 812. Support structure 818*a* may generally be a structure (e.g., metal structure), and is coupled to EMI shielding can 812. Support structure 818*a* may, in one embodiment, be arranged about the periphery of vibrating element 818*b*. As shown, support structure 818*a* may be coupled to EMI shielding can 812 using a gasket 816. Alternatively, it should be appreciated that support structure 818*a* may instead be substantially directly coupled to EMI shielding can 812.

Figure 9:
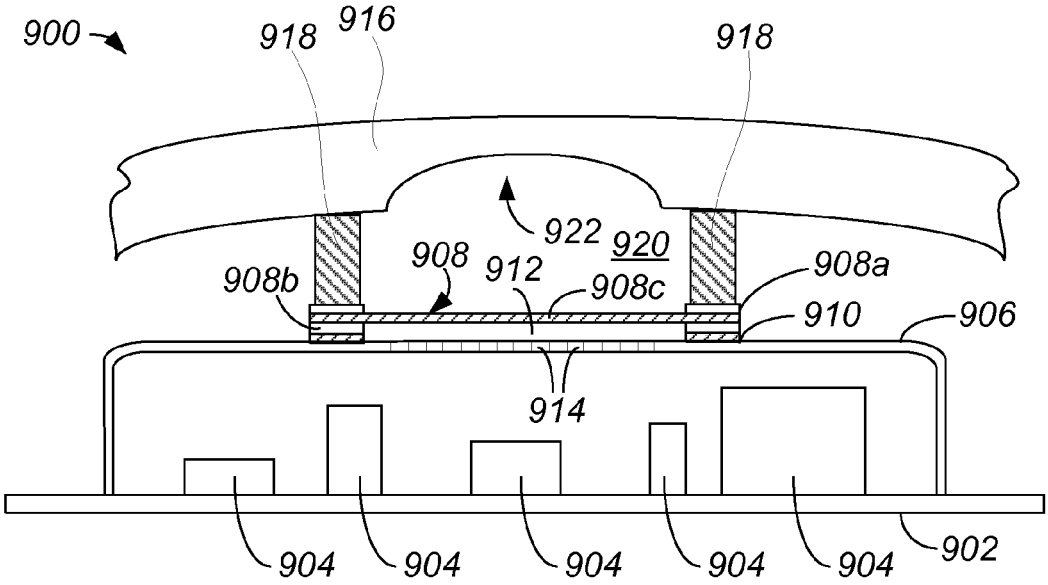
FIG. 9 illustrates a cross-sectional view of a portion of a portable electronic device according to one embodiment of the invention.

FIG. 9 illustrates a cross-sectional view of a portion of a portable electronic device 900 according to one embodiment of the invention. The portable electronic device 900 includes a PCB assembly having a PCB (or substrate) 902 having various components 904, e.g., electrical components, mounted thereon. An EMI shielding can 906 can be mounted to PCB 902 such that EMI shielding can 906 is essentially positioned around and over components 904. That is, EMI shielding can 906 is arranged to shield components 904.

A piezo speaker arrangement 908 is mounted on a top surface of EMI shielding can 906. Piezo speaker arrangement 908 includes a support member that holds a diaphragm 908*c*. More particularly, the support member can have a top portion 908*a* and a bottom portion 908*b*. In one implementation, the support member is a metal frame that is attached to the ends of diaphragm 908*c*. The diaphragm 908*c* can, for example, be disc-shaped piezo electric element, and the support member can have a ring shape. Support member 908*b* can be effectively attached to a top surface of EMI shielding can 906 through a gasket 910. That is, gasket 910 is the interface through which piezo speaker arrangement 908 is mounted on EMI shielding can 906. In one implementation, gasket 910 can pertain to double-sided adhesive tape (e.g., VHB). It should be appreciated, however, that in lieu of gasket 910, support member 908*b* may be substantially directly mounted to EMI shielding can 512, e.g., using an adhesive material such as epoxy. Regardless, piezo speaker arrangement 908 is sealed to the top surface of EMI shielding can 906. Between diaphragm 908*c* and the top surface of EMI shielding can 906 is an open region 912. Also, adjacent the open region 912 (or space), the top surface of EMI shielding can 906 includes one or more openings 914.

The portable electronic device 900 can also include a housing 916. The housing 916 can serve as an outer housing for portable electronic device 900. The PCB assembly with piezo speaker arrangement 908 are arranged within housing 916. Additionally, piezo speaker arrangement 908 can be sealed with respect to an inner surface of housing 916. In this regard, one or more seals 918 can seal an upper surface of piezo speaker arrangement 908 to the inner surface of housing 916. As examples, the seals 918 can be formed of silicone, rubber or other compliant material suitable for creating a seal. The sealing of piezo speaker arrangement 908 to the inner surface of housing 916 forms a sealed volume 920 that can serve as a back volume for piezo speaker arrangement 908. Additionally, the sealed volume 920 can be enlarged by a recessed area 922 in the inner surface of housing 916. The recessed area 922 can, for example, be formed through molding, machining or chemical etching. The presence of the recessed area 922 serves to enlarge the sealed volume 920 which increases the back volume for piezo speaker arrangement 908. The larger back volume can yield better audio quality and/or performance for piezo speaker arrangement 908. The resulting thinned portion of housing 916 at recessed area 922 may also provide improved acoustic performance by facilitating internally generally sound from propagating out of housing 916.

Figure 10A:
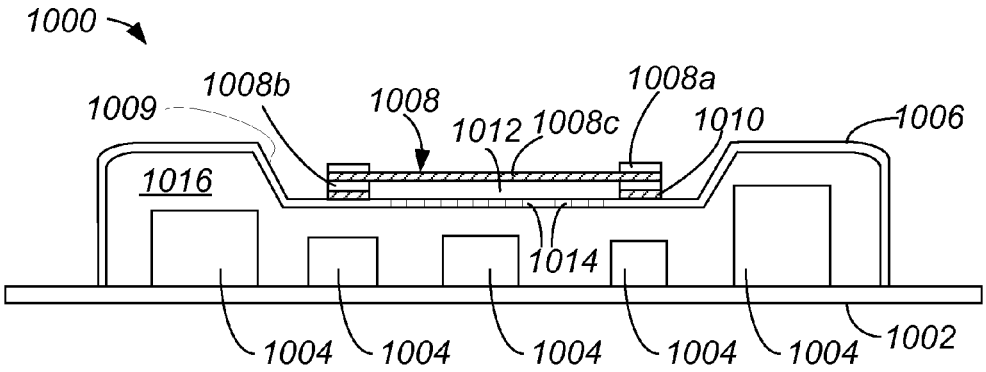
FIG. 10A illustrates a cross-sectional view of a PCB and speaker assembly according to one embodiment of the invention.

FIG. 10A illustrates a cross-sectional view of a PCB and speaker assembly 1000 according to one embodiment of the invention. The PCB and speaker assembly 1000 includes a PCB assembly having a PCB (or substrate) 1002 having various components 1004, e.g., electrical components, mounted thereon. An EMI shielding can 1006 can be mounted to PCB 1002 such that EMI shielding can 1006 is essentially positioned around and over components 1004. That is, EMI shielding can 1006 is arranged to shield components 1004.

The PCB and speaker assembly 1000 also includes a piezo speaker arrangement 1008 mounted on a top surface of EMI shielding can 1006. As illustrated in FIG. 10A, the top surface of EMI shielding can 1006 can include a recess area 1009. Piezo speaker arrangement 1008 can be mounted on the top surface of EMI shielding can 1006 at recess area 1009. Piezo speaker arrangement 1008 includes a support member that holds a diaphragm 1008*c*. More particularly, the support member can have a top portion 1008*a* and a bottom portion 1008*b*. In one implementation, the support member is a metal frame that is attached to the ends of diaphragm 1008*c*. The diaphragm 1008*c* can, for example, be a disc-shaped piezo electric element, and the support member can have a ring shape. Support member 1008*b* can be effectively attached to a top surface of EMI shielding can 1006 through a gasket 1010. That is, gasket 1010 is the interface through which piezo speaker arrangement 1008 is mounted on EMI shielding can 1006. In one implementation, gasket 1010 can pertain to double-sided adhesive tape (e.g., VHB). It should be appreciated, however, that in lieu of gasket 1010, support member 1008*b* may be substantially directly mounted to EMI shielding can 1006, e.g., using an adhesive material such as epoxy. Regardless, piezo speaker arrangement 1008 is sealed to the top surface of EMI shielding can 1006. Between diaphragm 1008*c* and the top surface of EMI shielding can 1006 is an open region 1012. Also, adjacent the open region 1012 (or space), the top surface of EMI shielding can 1006 includes one or more openings 1014.

In one embodiment, the open region 1012 together with an internal volume 1016 within EMI shielding can 1006 provide a sealed volume, which can be used as a back volume for piezo speaker arrangement 1008. In an alternative embodiment, although not shown in FIG. 10A, piezo speaker arrangement 1008 can alternatively or additionally be sealed to an inner surface of a housing such as illustrated in FIG. 9, thereby forming a sealed volume that can serve as a back volume for piezo speaker arrangement 1008.

Figure 10B:
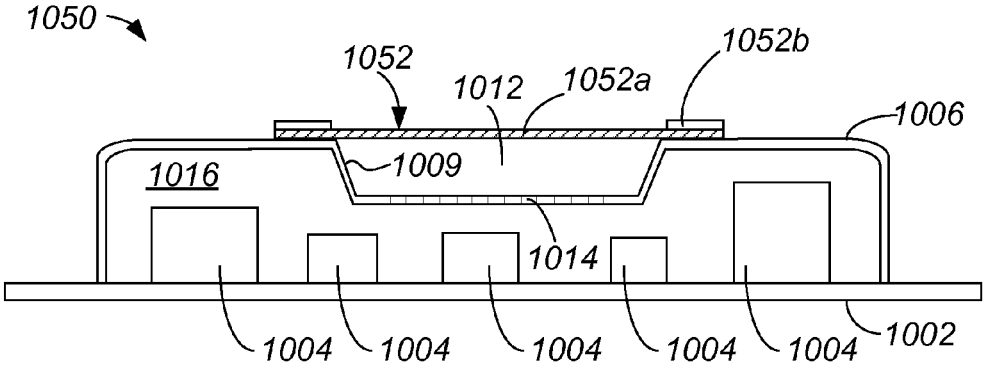
FIG. 10B illustrates a cross-sectional view of a PCB and speaker assembly according to another embodiment of the invention.

FIG. 10B illustrates a cross-sectional view of a PCB and speaker assembly 1050 according to another embodiment of the invention. The PCB and speaker assembly 1050 includes a PCB assembly having a PCB (or substrate) 1002 having various components 1004, e.g., electrical components, mounted thereon. An EMI shielding can 1006 can be mounted to PCB 1002 such that EMI shielding can 1006 is essentially positioned around and over components 1004. That is, EMI shielding can 1006 is arranged to shield components 1004.

The PCB and speaker assembly 1000 also includes a piezo speaker arrangement 1052 mounted on a top surface of EMI shielding can 1006. As illustrated in FIG. 10A, the top surface of EMI shielding can 1006 can include a recess area 1009. Piezo speaker arrangement 1052 can be mounted on the top surface of EMI shielding can 1006. Optionally, piezo speaker arrangement 1052 can mounted on the top surface of EMI shielding can 2006 at recess area 1009. Piezo speaker arrangement 1052 includes a support member 1052*a* that holds a diaphragm 1052*b*. In this embodiment, the support member 1052*a* is provided only on one side of diaphragm 1052*b*. In one implementation, the support member 1052*a* is a metal frame that is attached to the ends of diaphragm 1052*b*. The diaphragm 1052*b* can, for example, be a disc-shaped piezo electric element, and the support member can have a ring shape. Diaphragm 1052*b* can be effectively attached to a top surface of EMI shielding can 1006. The attachment can, for example, be performed using a thin layer of adhesive. Piezo speaker arrangement 1052*b* is thus sealed to the top surface of EMI shielding can 1006. Between diaphragm 1052*b* and the top surface of EMI shielding can 1006 is an open region 1012. Also, adjacent the open region 1012 (or space), the top surface of EMI shielding can 1006 includes one or more openings 1014.

In one embodiment, the open region 1012 together with an internal volume 1016 within EMI shielding can 1006 provide a sealed volume, which can be used as a back volume for piezo speaker arrangement 1052. In an alternative embodiment, although not shown in FIG. 10B, piezo speaker arrangement 1052 can alternatively or additionally be sealed to an inner surface of a housing such as illustrated in FIG. 9, thereby forming a sealed volume that can serve as a back volume for piezo speaker arrangement 1052.

Advantageously, piezo speaker arrangement 1052 has a reduced height (i.e., z-axis) as compared to piezo speaker arrangement 1008 illustrated in FIG. 10A. Namely, a bottom portion of a support member for diaphragm 1008*b* is eliminated. Instead, any additional structural support can be provided by EMI shielding can 1006 to which piezo speaker arrangement 1008 is attached. Also, gasket 1010 can be eliminated and, as noted above, a thin layer of adhesive can be used to secure piezo speaker arrangement 1008 to EMI shielding can 1006.

In still another embodiment, a piezo speaker arrangement could be mounted internal to an EMI shielding can. In such case, the EMI shielding can may operate as a sealed volume as all or part of a front volume or a back volume. The EMI shielding can may also serves to provide a protective housing for a piezo element of the piezo speaker arrangement.

Although only a few embodiments of the present invention have been described, it should be understood that the present invention may be embodied in many other specific forms without departing from the spirit or the scope of the present invention. By way of example, a piezo speaker has generally been described as including a vibrating element such as a diaphragm and a support member which supports the diaphragm. Such a vibrating element and support member are generally unprotected, as they are not encased in a protective case. However, in one embodiment, such a vibrating element and support member may at least be partially encased in a protective case.

While a piezo speaker has been described as being attached to or otherwise mounted on an EMI shielding can, it should be appreciated that a portion of the piezo speaker may be attached to the EMI shielding can while other portions of the piezo speaker may be mounted off of the EMI shielding can. For example, a piezo element that vibrates may be mounted on an EMI shielding can while other elements of the piezo speaker, such as a piezo driver, may be mounted off of the EMI shielding can. Typically, the piezo element that vibrates is a diaphragm or a membrane.

In general, a piezo speaker may be mounted on a top surface of an EMI shielding can. However, a piezo speaker is not limited to being mounted on a top surface of an EMI shielding can. For instance, a piezo speaker may be mounted on a side wall or a fence of an EMI shielding can.

An EMI shielding can may be configured to meet acoustical performance specifications as needed. That is, the material from which an EMI shielding can is formed, as well as the geometry of the EMI shielding can, may be altered to meet the acoustical requirements of particular systems in which the EMI shielding can is included. By way of example, the geometry of an EMI shielding can may be tuned to provide a desired range of frequencies. Tuning the geometry may include, but is not limited to including, varying the internal volume of the EMI shielding can, varying the flexibility of the various walls of the EMI shielding can, varying the material from which the various walls are formed, and/or varying the thickness of the various walls. Further, varying the rigidity and/or the stiffness of the EMI shielding can may allow the acoustical performance to be adjusted. In one embodiment, EMI shielding can may serve as a diaphragm of an overall speaker arrangement.

An EMI shielding can may be mounted to a PCB in a substantially fixed manner. That is, an EMI shielding can may be soldered to a PCB, as previously mentioned. Alternatively, however, an EMI shielding can may be attached to a PCB through a dampening or elastic material if, for example, acoustical qualities are such that attaching the EMI shielding can to a PCB through a dampening material is preferable.

In one embodiment, the electronic device as described herein is mobile electronic device that provides an audio output. In one implementation, the mobile device can be a handheld electronic device. The term hand-held generally means that the electronic device has a form factor that is small enough to be comfortably held in one hand of a user (person). A hand-held electronic device may be directed at one-handed operation or two-handed operation. In one-handed operation, a single hand is used to both support the device as well as to perform operations with the user interface during use. In two-handed operation, one hand is used to support the device while the other hand performs operations with a user interface during use or alternatively both hands support the device as well as perform operations during use. In some cases, the hand-held electronic device is sized for placement into a pocket of the user. By being pocket-sized, the user does not have to directly carry the device and therefore the device can be taken almost anywhere the user travels (e.g., the user is not limited by carrying a large, bulky and often heavy device).

The operations associated with the various methods of the present invention may vary widely. By way of example, steps may be added, removed, altered, combined, and reordered without departing from the spirit or the scope of the present invention.

The many features and advantages of the present invention are apparent from the written description. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. An electronic device comprising:

an electronic device housing;

a printed circuit board (PCB);

a component, the component being mounted on the PCB and substantially enclosing a first volume of air;

an audio exit opening arranged through a surface of the electronic device housing;

an audio seal enclosing a second volume of air within the electronic device housing, the second volume of air in direct contact with the component and the audio exit opening; and a speaker mounted on a surface of the component so that the first volume of air enclosed by the component serves as a back volume and the second volume of air serves as a front volume, the two volumes of air operative to enhance sound waves produced by the speaker.

2. An electronic device of claim 1, wherein the audio exit opening is also an opening for an electrical connector.

3. The electronic device of claim 1, wherein the speaker includes at least a diaphragm element arranged to vibrate when producing sound.

4. The electronic device of claim 1, wherein the surface of the component includes at least one opening, and wherein the speaker is at least partially mounted on the surface of the component over the at least one opening.

5. An electronic device comprising:

a printed circuit board (PCB);

at least one electrical component, the at least one electrical component being mounted on the PCB;

an electromagnetic interference (EMI) shield, the EMI shield being mounted directly to the PCB over and around the at least one electrical component and a first volume of air;

a second volume of air sealed within a portion of the electronic device, the second volume of air contained proximate to the EMI shield;

an audio exit opening configured to port audio out of the electronic device; and a speaker mounted on an exterior surface of the EMI shield so that the first volume of air enclosed by the EMI shield serves as a back volume and the second volume of air serves as a front volume, the first and second volumes of air operative to enhance sound waves produced by the speaker.

6. The electronic device of claim 5, wherein the audio exit opening is also an opening for an electrical connector.

7. The electronic device of claim 5, wherein the speaker includes at least a diaphragm element arranged to vibrate when producing sound.

8. The electronic device of claim 5, wherein the first volume of air within the EMI shield is substantially sealed such that the first volume of air is confined within the EMI shield.

9. The electronic device of claim 5, further comprising:

an electronic device housing; and at least one seal configured to confine the second volume of air within the portion of the electronic device, wherein the second volume of air is arranged within the electronic device housing and in direct contact with the audio exit opening.

10. The electronic device of claim 5, wherein the EMI shield is arranged to amplify sound associated with the speaker.

11. The electronic device of claim 5, wherein the speaker comprises a piezoelectric speaker.

12. The electronic device of claim 5, wherein the EMI shield includes a recess area at a portion of the surface, and wherein the speaker is mounted on the surface of the EMI shield at the recess area.

13. The electronic device of claim 5, wherein the EMI shield includes a recess area at a portion of the surface, and wherein the speaker is mounted on the surface of the EMI shield in the recess area.

14. The electronic device of claim 5, wherein the EMI shield includes a recess area at a portion of the surface, and wherein the speaker is mounted on the surface of the EMI shield over the recess area.

15. The electronic device of claim 5, wherein the speaker includes at least a diaphragm element arranged to vibrate when producing sound, and wherein a support member holds the diaphragm element to the EMI shield.

16. The electronic device of claim 9, wherein a first end of the at least one seal is coupled to inner surface of the electronic device housing and a second end of the at least one seal is coupled directly to the speaker.

17. The electronic device of claim 9, wherein the EMI shield can includes a top surface, wherein the top surface includes at least one opening, and wherein the speaker arrangement is at least partially mounted on the top surface over the at least one opening.

18. The electronic device of claim 17, wherein a first end of the at least one seal is coupled to an inner surface of the electronic device housing and a second end of the at least one seal is coupled directly to the speaker.

19. The electronic device of claim 17, wherein the EMI shield includes a recess area at a portion of the top surface, and wherein the speaker is mounted on the surface of the EMI shield at the recess area.

20. The electronic device of claim 19, wherein a first end of the at least one seal is coupled to an inner surface of the electronic device housing and a second end of the at least one seal is coupled directly to the speaker.

21. An audio system disposed within an enclosure, the audio system comprising:

a printed circuit board (PCB);

an electromagnetic interference (EMI) shield coupled directly to the PCB and surrounding a first volume of air;

a speaker coupled to an exterior surface of the EMI shield;

a seal confining a second volume of air within a portion of the enclosure such that the second volume of air is in contact with the exterior surface of the EMI shield, wherein the first and second volumes of air act respectively as back and front volumes of air for the speaker, the front and back volumes of air operative to enhance sound waves produced by the speaker.

22. The audio system as recited in claim 21, wherein an audio exit opening is disposed through a surface of the enclosure and configured to port audio out of the enclosure.

23. The audio system as recited in claim 22, wherein an opening in the EMI shield is in contact with a surface of the speaker that is in direct contact with the EMI shield.

* * * * *